United States Patent [19]

Bomberger, Jr.

[11] 4,129,438

[45] Dec. 12, 1978

[54] METHOD OF ADDING TRACE ELEMENTS TO BASE METALS

[75] Inventor: Howard B. Bomberger, Jr., Canfield, Ohio

[73] Assignee: RMI Company, Niles, Ohio

[21] Appl. No.: 795,340

[22] Filed: May 9, 1977

Related U.S. Application Data

[63] Continuation-in-part of Ser. No. 669,534, Mar. 23, 1976, abandoned.

[51] Int. Cl.[2] ..... C22C 15/00

[52] U.S. Cl. ..... 75/10 C; 75/175.5

[58] Field of Search ..... 75/10 R, 10 C, 135, 75/175.5, 84, 84.1, 126 G, 168 J

[56] References Cited

U.S. PATENT DOCUMENTS

| | | | |
|---|---|---|---|
| 3,004,848 | 10/1961 | Hansley et al. | 75/135 |
| 3,360,366 | 12/1967 | Bonis | 75/135 X |
| 3,378,671 | 4/1968 | Harrison et al. | 75/175.5 X |
| 3,379,522 | 4/1968 | Vordahl | 75/175.5 X |
| 3,433,626 | 3/1969 | Bomberger | 75/175.5 X |
| 3,535,103 | 10/1970 | Whitfield | 75/135 X |
| 3,565,602 | 2/1971 | Konisi et al. | 75/175.5 |
| 3,622,406 | 11/1971 | Vordahl | 75/175.5 X |
| 3,645,727 | 2/1972 | Finlay et al. | 75/175.5 |
| 3,679,403 | 7/1972 | Bomberger et al. | 75/175.5 |
| 3,963,525 | 6/1976 | Bomberger et al. | 75/175.5 X |

FOREIGN PATENT DOCUMENTS

| | | | |
|---|---|---|---|
| 726203 | 3/1955 | United Kingdom | 75/175.5 |

*Primary Examiner*—L. Dewayne Rutledge
*Assistant Examiner*—Peter K. Skiff
*Attorney, Agent, or Firm*—Walter P. Wood

[57] ABSTRACT

A method of adding trace elements to a base metal, particularly useful for adding yttrium or a rare earth metal to titanium. This method is especially useful for adding these and other trace elements which have low solubility in the base metal or a high melting point and tend to form undesirable segregates in the microstructure. The invention overcomes this difficulty by dispersing finely divided particles of trace element in a vehicle before adding the trace element to a melt charge. The vehicle may be finely divided base metal, or a solvent and diluent.

7 Claims, 4 Drawing Figures

METHOD OF ADDING TRACE ELEMENTS TO BASE METALS

This application is a continuation-in-part of my earlier application Ser. No. 669,534 filed Mar. 23, 1976 now abandoned.

This invention relates to improved methods of adding trace elements to base metals and to the resulting product.

An earlier patent to Bomberger and Seagle U.S. Pat. No. 3,679,403 describes the addition of yttrium in amounts of about 0.03 to 0.40 percent to titanium-base alloys for the purpose of improving the macrostructure of the alloy. Another earlier patent to the same two inventors, U.S. Pat. No. 3,963,525, discloses a method of producing a hot-worked titanium product in which yttrium or a rare earth metal of atomic number 57 to 71 in amounts of about 0.001 to 0.10 percent is added as a workability-enhancing agent. Although the present invention is not thus limited, the methods disclosed herein are particularly useful for adding yttrium or rare earths to titanium in practicing the inventions claimed in the foregoing patents, both of which are of common ownership. As in the latter, the term "titanium", when used herein without further qualification, refers to the various titanium-base alloys, such as Ti-5Al-2.5Sn, Ti-6Al-2Cb-1Ta-0.8Mo, Ti-6Al-4V, Ti-8Al-1Mo-1V, Ti-6Al-2Sn-4Zr-2Mo with or without added Si, etc. as well as to unalloyed titanium metal. The term "trace element" as used herein refers to any element added intentionally, the content of which is within the range of about 0.001 to 0.10 percent of the base metal. The trace element may be added in elemental form, as a chemical compound of the trace element, or as an alloy which includes the trace element. All percentages stated herein are by weight.

Yttrium or rare earth particles incorporated as trace elements in a titanium melt charge tend to oxidize during the melting operation if not already in an oxidized form. The oxide particles tend to agglomerate or form clusters which appear in the resulting ingot as objectionable microscopic segregates. Under a microscope elongated segregates of these trace elements of a dimension of 10 microns or more may be observed in wrought products as dark streaks in lightly etched or unetched sections taken through the product. Particles of this size tend to adversely affect forged or rolled products made from the ingot, most noticeably in the ductility and smooth fatigue strength in the short transverse direction. Particles which have maximum dimension less than about 10 microns are not considered detrimental. Double or triple melting the ingot is beneficial in diminishing segregation, but has not succeeded in overcoming the problem.

The conventional way of preparing titanium specimens for metallographic examination is to polish a surface electrolytically or mechanically and etch the surface with an acid. One of the most common etchants is a solution of 2% $HNO_3$ and 0.5% HF in water. This etch reveals the grain structure and primary phase of alpha and beta, but obscures fine segregates which blend in with the structure. As a consequence, the presence of objectional segregates has escaped notice in titanium products to which yttrium or rare earths had been added until indicated by a loss in mechanical properties. To observe these segregates, the acid etching step must be omitted when the specimen is prepared for microscopic examination.

An object of the present invention is to provide improved methods of adding trace elements of low solubility of high melting points to metals in which I overcome the tendency of particles of the trace element to form undesirably large microscopic segregates.

A further object is to provide methods of adding trace elements of low solubility or high melting points to titanium in which finely divided particles of trace element are dispersed in a vehicle and added to the melt charge before the charge is melted to form an ingot.

A further object is to provide a new titanium product which contains a trace element in the form of minute highly dispersed particles not observable as dark streaks in a lightly etched section.

Figure 1:
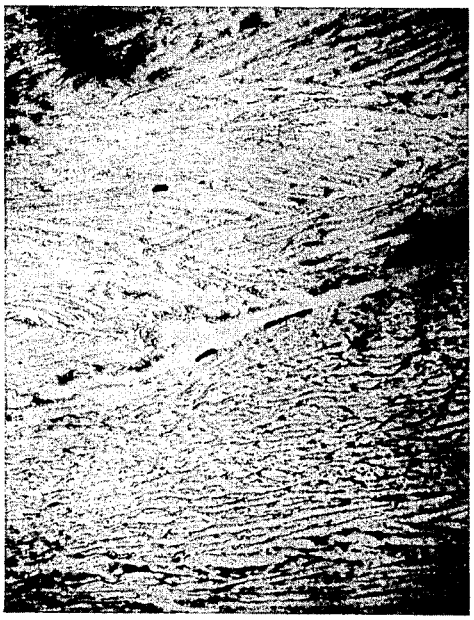
FIG. 1 is a 400X photomicrograph of a lightly etched section taken from a double-melted ingot of Ti-6Al-4V alloy which contains 0.018% Y added as −325 mesh $Y_2O_3$ powder directly to the melt charge.

According to the present invention, finely divided particles of trace element are first thoroughly dispersed in a vehicle before the trace element is incorporated in the base metal of the melt charge. Perhaps the simplest way of practicing the invention is to use finely divided base metal or other metal of a composition compatible with the composition of the charge as the vehicle. A master mix is prepared by blending powdered trace element with finely divided vehicle metal in ratios of about 9 to 199 parts of vehicle to 1 part of trace element. The powdered trace element should be at least as fine as −200 mesh and preferably −325 mesh, but the vehicle particles may be coarser, as large as −100 mesh. The metal particles of the vehicle may be of the same composition as intended for the ingot, or the composition may be different if necessary adjustements are made in the other constituents of the charge, provided no unwanted elements are present. For example, finely divided commercially pure titanium may be used conveniently as the vehicle in adding trace element to titanium-base alloys. Likewise, fine aluminum and other metal powders can be used as a vehicle for alloys containing such elements. The master mix, in which the metal particles serve as a vehicle for the trace element, is readily analyzed to confirm its composition, then blended with other metals going into the charge to form a charge of uniform composition throughout. The charge is melted to form an ingot.

Another way of obtaining the desired initial dispersion is to dissolve the trace element in a suitable solvent, dilute the solution with water or other diluent, and disperse the dilute solution over the materials going into the melt charge. The charge is carefully dried before it is melted. In the example of yttrium, or rare earths to be added to titanium, acids, such as HCl or HF, are suitable solvents. When the solution is diluted, sufficient acidity (pH value of 4 or less) is maintained to avoid precipitation of the trace element. The solution, which serves as a vehicle for the trace element, should wet all particles of the melt charge. Conveniently the charge may be vacuum dried in a conventional manner at about 170F. Presently I regard this second mode as the best mode of practicing the invention since the particle size of the trace element is finest.

The examples which follow represent tests conducted with laboratory size ingots of Ti-6Al-4V alloy. Most of the ingots were melted only one time because I found that single melts were more reliable than double melts for indicating the relative effectiveness of the different ways of adding trace elements. Double and triple melting produce more homogeneous metal and are desirable where good quality is an objective, but are less suited for purposes of comparison.

The materials for the melt charge consisted of the desired trace element, 50 pounds of sponge titanium, 5 pounds of a 55Al-45V master alloy and sufficient aluminum shot to furnish a balanced Ti-6Al-4V alloy. These materials were blended together, pressed into briquettes, assembled by welding into a homogeneous electrode and consumably vacuum arc melted to produce a 6-inch diameter ingot weighing about 55 pounds. The ingots were sectioned through the top, center and bottom, and these sections were hot rolled to 0.125-inch thick sheet. The sheets were electrolytically polished and carefully examined microscopically to observe any segregates, their size and distribution. The same procedure was used for all evaluations, although a few ingots were also vacuum melted a second time to determine the effect on undissolved segregates. Remelting was beneficial in diminishing segregation, but did not provide the desired homogeneity.

EXAMPLE 1

Powdered $Y_2O_3$ at $-325$ mesh and weighing 0.020 pound was added directly to the raw materials described above and blended. The resulting charge was double-melted, and the ingot sectioned, rolled, etched and examined as described above. FIG. 1 is a photomicrograph of the section thus obtained. Several dark streaks may be observed on the section. These streaks are undesirably large segregates of $Y_2O_3$. The longest streak a little above the center has a length of about 22 microns.

EXAMPLE 2

Figure 2:
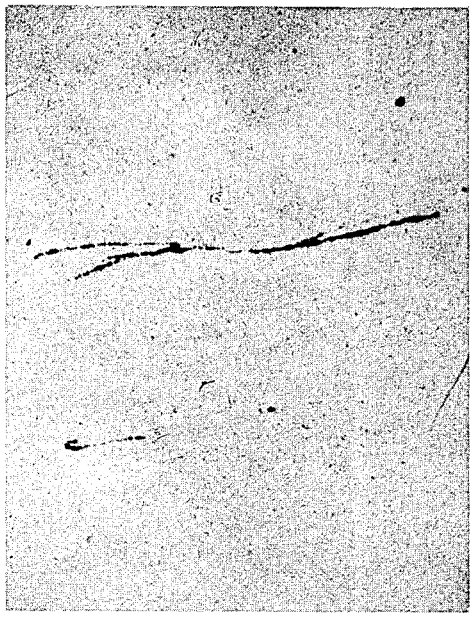
FIG. 2 is a similar photomicrograph of a section of the same alloy single-melted containing 0.024% Y added as small metallic chips directly to the melt charge.

0.0165 pound of small yttrium metal chips, produced by lathe turning, were employed as the additive to the melt charge, which was processed the same as in Example 1, except that the ingot was only single-melted. FIG. 2 is a photomicrograph of the section thus obtained. Again dark streaks may be observed. The long dark streak above the center is a particle of $Y_2O_3$ of a length of approximately 160 microns.

EXAMPLE 3

Figure 3:
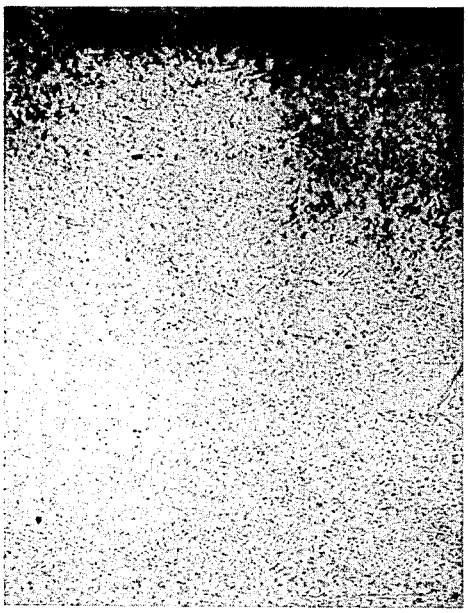
FIG. 3 is a similar photomicrograph of a section of the same alloy single-melted containing 0.023% Y added in accordance with one embodiment of the present invention.

The additive consisted of 0.020 pound of $-325$ mesh of $Y_2O_3$ powder carefully blended with $-100$ mesh commercially pure titanium powder in a ratio of 24 parts Ti to 1 part $Y_2O_3$ to form a master mix. The master mix was added to the raw materials prior to blending, electrode construction and melting. The resulting ingot had a Y content of 0.023%. FIG. 3 is a photomicrograph of a section of this ingot prepared as described hereinbefore. FIG. 3 shows a very significant improvement over FIGS. 1 and 2. There are no long dark streaks and only a few small scattered particles, the maximum dimension of which is less than 10 microns. These particles were not verified as $Y_2O_3$. Particles of similar appearance normally are observed in titanium microstructure to which no $Y_2O_3$ is added. Similar results were obtained on varying the ratio at a number of levels between 9 and 199 parts of titanium powder to 1 part $Y_2O_3$.

EXAMPLE 4

The procedure was similar to that followed in Example 3, except that $Y_2O_3$ of a particle size less than 7 microns was used, and the ratio in the master mix was 49 to 1. Examination showed excellent results are achieved by this procedure. This further confirms that the procedure provides very small particles and good distribution.

EXAMPLE 5

Figure 4:
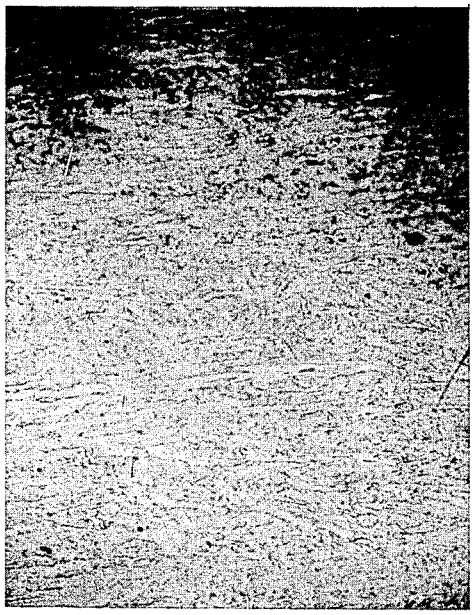
FIG. 4 is a similar photomicrograph of a section of the same alloy single-melted containing 0.021% Y added in accordance with another embodiment of the invention.

15 grams $Y_2O_3$ were first dissolved in 25 ml concentrated HCl. The solution was diluted to 11.25 liters, maintaining sufficient acidity to avoid precipitation of a yttrium compound. This liquid was carefully sprinkled over the titanium sponge to wet essentially all the sponge particles, after which the sponge was blended and vacuum dried in a conventional manner at 170F. After the other raw materials were added to produce Ti-6Al-4V alloy, an ingot was prepared and examined by the procedure hereinbefore described. FIG. 4 is a photomicrograph of the resulting section. Again the section is free of dark streaks.

Successful variants of this example included the use of other yttrium concentrations in the vehicle and in the final alloy and the use of methyl alcohol as a vehicle in which the initial solution is diluted. Alcohol permits more rapid drying than water but is more costly. Another variant involves applying the dilute solution to wet sponge metal after the leaching operation and prior to the conventional drying operation.

From the foregoing description and examples, it is seen that my invention affords simple effective methods of adding trace elements to base metals such as titanium and assuring that the trace element will be uniformly and fully dispersed throughout the base metal and any particles will be extremely small. When the trace element particles are properly dispersed in a vehicle, individual oxide particles are remote from one another and have little or no opportunity to meet one another and coalesce in the vehicle or in the subsequent blend. Contrasted with prior methods, sections of the product exhibit no large or elongated particles of trace element in their microstructure. It should be apparent to those skilled in the art that my invention has applications beyond those specifically described for avoiding segregation which results when small additions are made to metals.

I claim:

1. In a process in which a consumable electrode of titanium base metal is assembled and said electrode is melted to form an ingot, a method of adding a trace element to said ingot to produce a content of 0.001 to 0.10 percent of trace element in the ingot in the form of minute highly dispersed particles not observable as undesirably large segregates in a lightly etched section, said trace element being of the group consisting of yttrium and a rare earth metal of atomic number 57 to 71, said method comprising dispersing finely divided particles of the trace element in a vehicle, and blending the vehicle and dispersed trace element with finely divided base metal of the electrode to form an electrode of uniform composition throughout before melting the electrode.

2. A method as defined in claim 1 in which the trace element is in the form of an oxide or other compound when dispersed in the vehicle.

3. In a process in which a consumable electrode of titanium base metal is assembled and said electrode is melted to form an ingot, a method of adding a trace element to said ingot to produce a content of 0.001 to 0.10 percent of trace element in the ingot in the form of minute highly dispersed particles not observable as undesirably large segregates in a lightly etched section, said trace element being of the group consisting of yttrium and a rare earth metal of atomic number 57 to 71, said method comprising dispersing finely divided particles of trace element of minus 200 mesh or finer in size in a vehicle of finely divided metal of a composition compatible with the composition of the electrode and of minus 100 mesh or finer in size in a ratio of about 9 to 199 parts of metal to 1 part of trace element, and blending the vehicle and dispersed trace element with finely divided base metal of the electrode to form an electrode of uniform composition throughout before melting the electrode.

4. A method as defined in claim 3 in which the vehicle metal is the base metal of the electrode or commercially pure titanium.

5. A method as defined in claim 3 in which the vehicle metal is an alloying constituent of the electrode.

6. In a process in which a melt charge of titanium base metal is assembled and said charge is melted to form an ingot, a method of adding a trace element to said ingot to produce a content of 0.001 to 0.10 percent of trace element in the ingot in the form of minute highly dispersed particles not observable as undesirably large segregates in a lightly etched section, said trace element being of the group consisting of yttrium and a rare earth metal of atomic number 57 to 71, said method comprising dissolving particles of trace element in an acid solvent and a diluent as a vehicle, the diluent being water or alcohol, dispersing the solution of vehicle and trace element on finely divided base metal or the constituents of the charge, and drying the charge before melting it.

7. A method as defined in claim 6 in which said acid solvent is HCl or HF.

* * * * *